United States Patent [19]

Johnson

[11] 4,048,869

[45] Sept. 20, 1977

[54] SHIFTING MECHANISM FOR CONTROL ELEMENTS

[75] Inventor: Donald L. Johnson, Kenosha, Wis.

[73] Assignee: J. I. Case Company, Racine, Wis.

[21] Appl. No.: 681,267

[22] Filed: Apr. 28, 1976

[51] Int. Cl.[2] ..... G05G 9/00

[52] U.S. Cl. ..... 74/471 R; 74/473 R

[58] Field of Search ..... 74/471 R, 471 XY, 473 R

[56] References Cited

U.S. PATENT DOCUMENTS

| | | | |
|---|---|---|---|
| 1,527,247 | 2/1925 | Bouillon | 74/471 R X |
| 2,691,080 | 10/1954 | Kellogg | 74/471 R X |
| 3,541,876 | 11/1970 | Gressard | 74/471 R |

*Primary Examiner*—Allan D. Herrmann

*Attorney, Agent, or Firm*—Dressler, Goldsmith, Clement, Gordon & Shore, Ltd.

[57] ABSTRACT

A shifting mechanism including a shifting lever for moving two control elements is disclosed herein. The control elements and shifting lever are interconnected in such a fashion that one of the control elements can be moved to a plurality of positions while the other control element remains in any one of a plurality of positions.

9 Claims, 5 Drawing Figures

28
36
A
32
31
54
52
44
46
50
56
48
76
48a
90
72
74
40
34
92
90
84
94
84
92
82
A
62

SHIFTING MECHANISM FOR CONTROL ELEMENTS

BACKGROUND OF THE INVENTION

The present invention relates generally to shifting mechanisms and more particularly to an improved control mechanism wherein a single lever can be utilized for controlling two different movable control elements.

With the increased automation of various operations, particularly in the field of agricultural equipment, most present day tractors incorporate a number of controls that must be individually controlled by the operator. For example, multi-speed, multi-range transmissions have been incorporated into large agricultural tractors in recent years. One example of such a transmission is disclosed in Bislew U.S. Pat. No. 3,469,472. The transmission disclosed therein consists of two different units that are operatively interconnected so that the vehicle can be operated in as many as twelve different speeds in the forward direction and four speeds in the reverse direction. The transmission disclosed in the Bislew patent incorporates a multi-speed planetary drive unit which is coupled to a multi-speed sliding gear unit so that the planetary gear unit can be set for three forward speeds and one reverse speed. The multiple speed sliding gear unit is designed so that the vehicle can be operated at four different ranges for any one of the four different settings for the planetary unit. Thus, the operator has the capability of operating the vehicle at twelve different forward speeds and four different reverse speeds.

One of the problems encountered with multi-speed transmissions of this type is that such a unit requires a large number of control elements. For example, the transmission shown in the Bislew patent requires actuation of two control elements for the sliding gear unit and a further control element for operating the main control valve that shifts the planetary drive unit as well as a foot pedal for operating the modulating valve.

It has now been proposed to further increase the versatility of the transmission of the type disclosed in the Bislew patent to double the number of speeds at which the unit can be operated. This can be accomplished by producing an input into the transmission which is operated at two different speeds. This can be performed by a clutch arrangement between the engine and the input shaft for the transmission disclosed in the Bislew patent. However, the arrangement requires a further control valve for actuating the clutch. The additional clutch of necessity requires a further or fourth control element for actuating the control valve that cooperates with the input clutch.

SUMMARY OF THE INVENTION

According to the present invention, there is provided a unique shifting mechanism which is capable of shifting two control elements between a plurality of positions. The shifting mechanism includes a control lever that cooperates with both of the elements and is connected thereto in such a fashion that the first control element can be shifted to a plurality of positions while the second control element is in any one of a plurality of positions.

The shifting mechanism of the present invention includes a control lever for shifting first and second control elements that are pivoted about first and second fixed axes that are angularly related to each other. The lever is rotated about the first axis and engages the first control element so that rotation of the lever about the first axis will move the first element to a plurality of locations. The lever is also pivotable between a plurality of positions along the first axis and cooperates with an elongated member which pivots the second control element in response to pivotal movement of the control lever to a plurality of positions. The elongated member is constructed and designed so that the control lever can be rotated about the first axis while the second control element is in any one of the plurality of positions.

The shifting mechanisms also incorporates guide means that cooperate with the control lever for guiding the lever in any one of the plurality of positions. The guide means consists of a quadrant that is spaced from the first axis and defines first and second axially spaced arcuate recesses that receive a projection on the lever for guiding the lever. The recesses are interconnected by slots at circumferentially spaced locations so that the control lever can be shifted between the recesses at any one of a plurality of positions.

DETAILED DESCRIPTION

Figure 1:
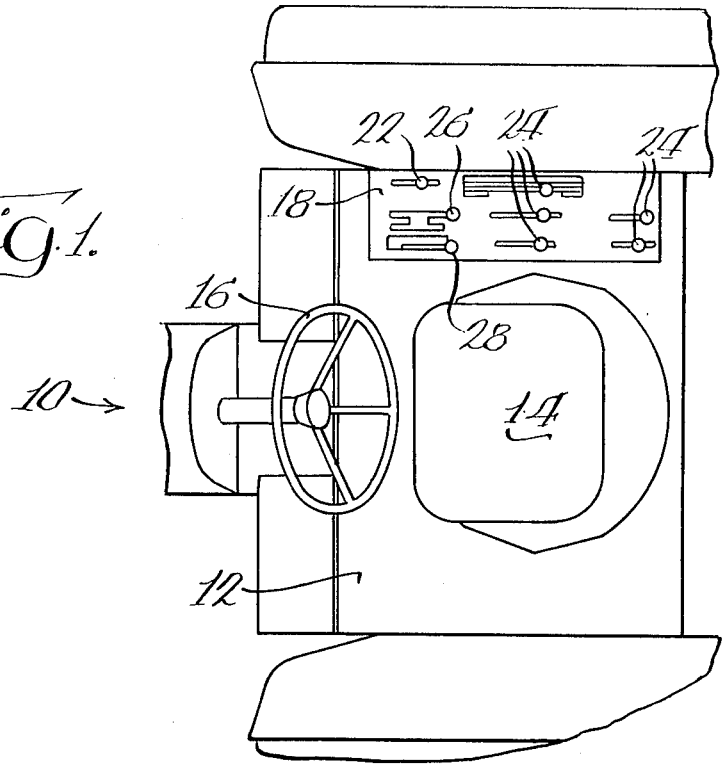
FIG. 1 shows a fragmentary plan view of the operator's compartment of a tractor.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawing discloses a fragmentary portion of a tractor 10 that has an operator's compartment 12 which includes a seat 14 and a steering wheel 16 with a control console 18 located on one side of the seat 14. The control console houses a plurality of levers which are utilized for actuating the various devices that must be operated during the normal use of the tractor. The control console may be of the type disclosed in U.S. Pat. No. 3,550,715, which is assigned to the assignee of the present invention.

Control console has a manually actuatable throttle lever 22 and a plurality of control levers 24 which can be utilized for controlling various remote functions, such as the draft control system that is normally part of such a tractor, as well as remote hydraulically actuated functions. Control console 18 also incorporates a lever 26 which is designed for operating the sliding gear transmission unit disclosed in Bislew U.S. Pat. No. 3,469,472, the portions of which are not inconsistent with this disclosure being incorporated herein by reference. Control lever 26 may be designed as disclosed in U.S. Pat. No. 3,522,744, which is also assigned to the assignee of the present invention.

Control lever 28 has a control knob 29 at one end and is designed to operate a selector valve spool of the type disclosed in the Bislew patent as well as a two-position control valve which is capable of engaging or disengaging a clutch associated with the input shaft to the transmission so that the input shaft can be operated at two different speeds.

According to the present invention, control lever 28 is designed and mounted so that the selector valve of a transmission can be moved to a plurality of positions while the clutch associated with the input shaft is in either of two operating positions.

Figure 2:
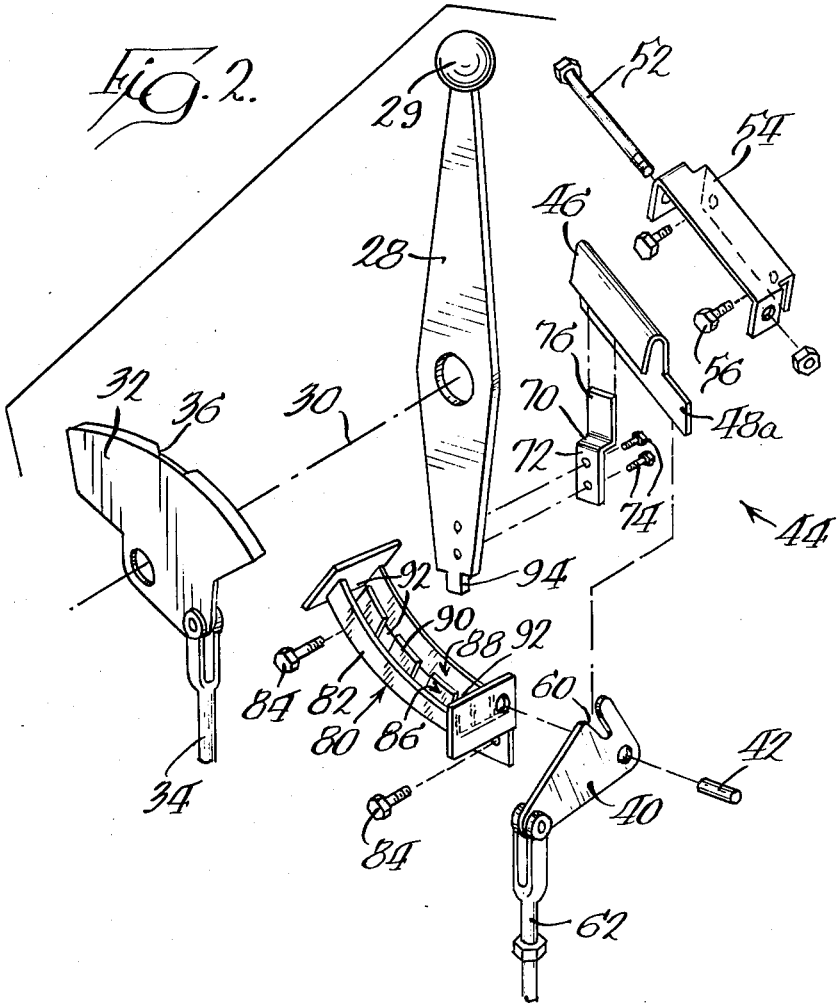
FIG. 2 is an exploded perspective view of the shifting mechanism constructed according to the present invention.
Figure 3:
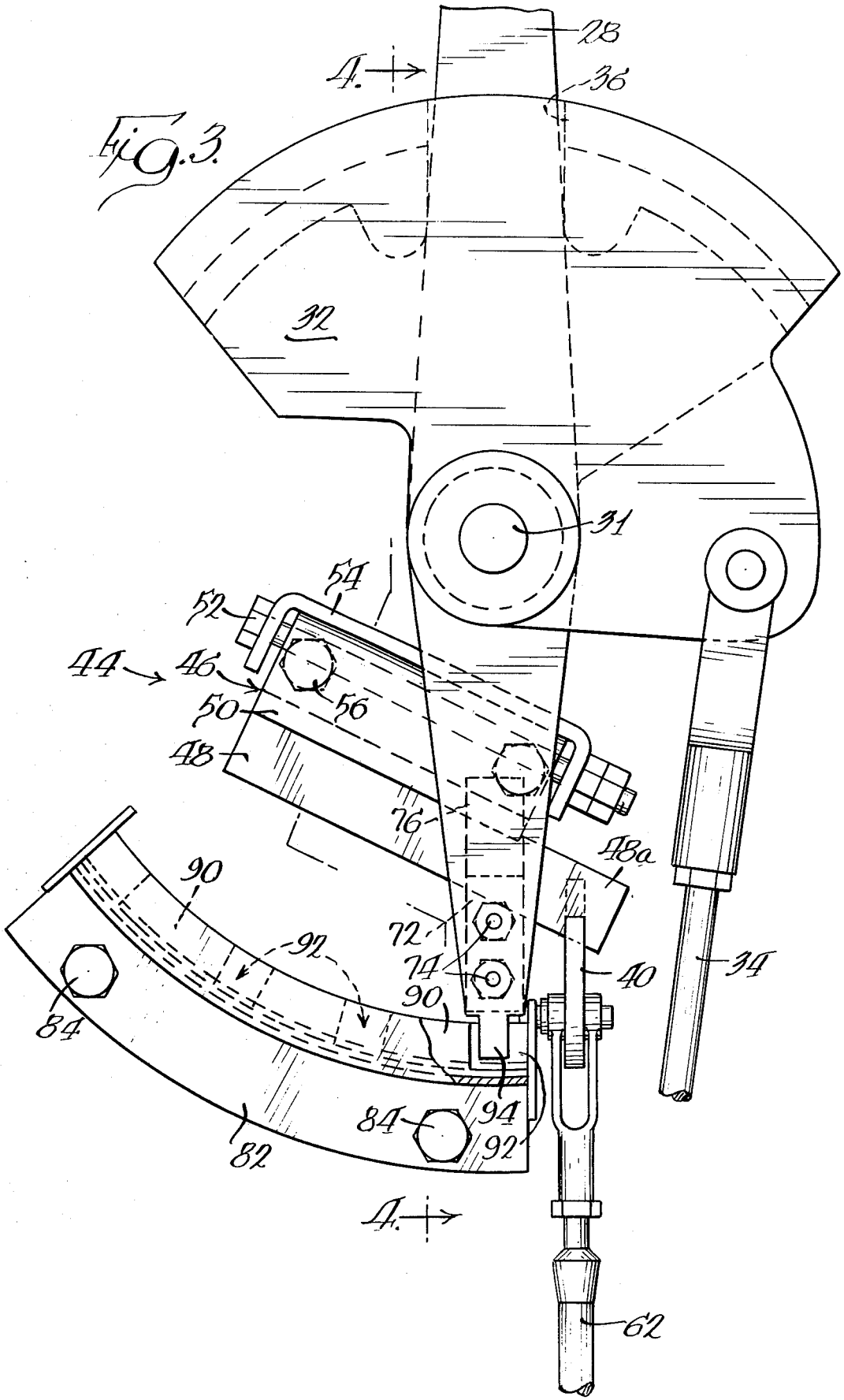
FIG. 3 is a side elevational view, partly in section, showing the shifting mechanism in an assembled condition.

The details of the shifting associated with control lever 28 are shown in exploded view in FIG. 2. Control lever 28 is rotated about a fixed axis 30 which may be defined by a shaft 31 (FIG. 4) adjacent a first control member or element 32 that is also rotatably supported on the shaft defining axis 30. Control element 32 is connected by an adjustable link 34 to the valve spool of a selector valve (not shown) of the type disclosed in the Bislew patent. Control element or member 32 also has a notch or recess 36 which receives an upper portion of control lever 28 so that rotational movement of control lever 28 about axis 30 will rotate control element 32 between a plurality of locations or distinct positions. For example, the control element, when operating a transmission selector valve of the type disclosed in the Bislew patent, will be moved between four different locations or distinct positions, which respectively define reverse, first, second and third gears for the planetary transmission unit.

According to the present invention, the single control lever 28 is also utilized for actuating a further control valve so that the transmission may be operated at any one of a plurality of input speeds for each of the four settings mentioned above. Furthermore, the control valve may be maintained in an actuated position while the control lever is moved between the respective locations for moving control element 32 between the respective locations.

Figure 4:
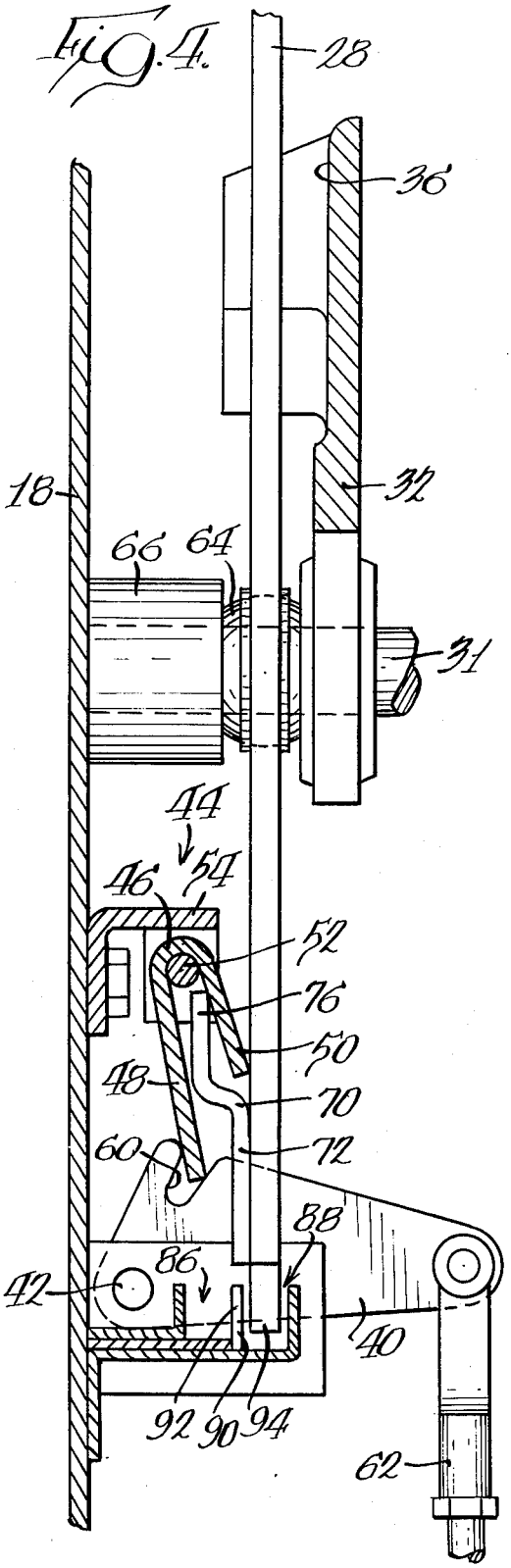
FIG. 4 is a vertical section, as viewed generally along 4—4 of FIG. 3 showing the shifting lever in a first position.

Referring to FIGS. 2 and 4, cooperating means 44 operatively interconnect control lever 28 with control element 40 without any direct connection. Cooperating means 44 consists of an elongated member 46 that is generally U-shaped in cross section and has first and second opposed legs 48 and 50 (FIG. 4). Elongated member 46 is pivoted on a pin 52 that is supported between opposed legs of a bracket 54 which is secured to a wall of control console 18 through bolts 56. U-shaped member 46 has an extension 48*a* defined on leg 48 which extension is received into a recess 60 that is defined on second control element 40 at a location spaced from pivot bolt 42. A free end of control element 40 is connected to the valve spool of a control valve (not shown) through an adjustable cable 62.

Figure 5:
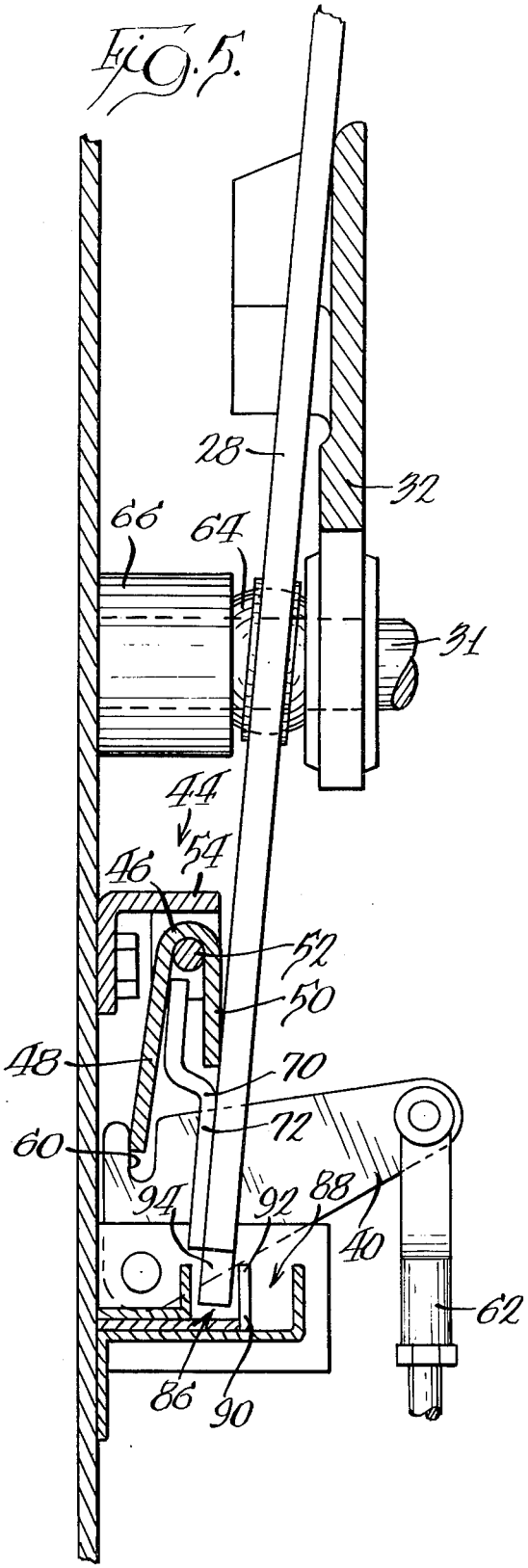
FIG. 5 is a view similar to FIG. 4 showing the shifting mechanism in a second position.

As illustrated in FIGS. 4 and 5, control lever 28 is supported on a generally spherical member 64 that is located between a hub 66 on shaft 31 and control element 32. Thus, control lever 28 can be pivoted along a plane that extends through the axis of shaft 31. The lower end of control lever 28 has an arm 70 secured thereto. As shown in FIGS. 2, 4 and 5, arm 70 has a first portion 72 connected directly to the lower end of control lever 28 through screws 74. Arm 70 has an intermediate offset portion so that the opposite offset end 76 of arm 70 is spaced from the adjacent surface of control lever 28. As most clearly shown in FIGS. 4 and 5, the offset end 76 of arm 70 on control lever 28 is received into the space defined between opposed legs 48 and 50 of elongated member 46.

With the apparatus so far described, pivotal movement of control lever from the position illustrated in FIG. 4 to the position illustrated in FIG. 5 will pivot elongated member 46 about bolt 52 and move second control element 40 between the two positions respectively illustrated in FIGS. 4 and 5. This movement will be sufficient to cause cable 62 to move a valve spool associated therewith between two positions.

In either of the positions, respectively illustrated in FIGS. 4 and 5, control lever 28 can still be rotated about axis 30 defined by shaft 31. During this rotational movement, the offset portion 76 of arm 70 can be moved along the area between legs 48 and 50 of U-shaped member 46. This means that control element 32 can be rotated to a plurality of locations while control element 40 is held in either of the two positions shown in FIGS. 4 and 5.

According to another aspect of the invention, the shifting mechanism also incorporates guide means 80 that cooperate with lever 28 for guiding the lever along predetermined paths in either position for control element 40. Guide means 80 consists of a generally arcuate quadrant 82 that is secured to the housing of console 18 through bolts 84. As most clearly illustrated in FIGS. 2, 4 and 5, quadrant 82 defines first and second arcuate elongated recesses 86 and 88 that extend generally parallel to each other and are separated by a divider plate 90. Divider plate 90 has a plurality of slots 92 (four being illustrated in the drawings) which interconnect arcuate recesses 86 and 88 at circumferentially spaced locations. These circumferentially spaced locations preferably coincide with the respective positions for control element 32 when the transmission is in any one of the three forward or the reverse setting. The lower end of control lever 28 has a projection 94 that is positioned to be aligned and moved in either of the recesses 86 or 88 in the respective positions for control lever 28. Thus, recesses 86 and 88 define arcuate paths for projection 94 when the control lever 28 is in either the position illustrated in FIG. 4 or the position illustrated in FIG. 5 and is rotated about pivot axis 30.

As can be appreciated from the above description, the present invention provides a unique arrangement wherein two control units can be controlled by a single control lever and one control unit can be shifted to a plurality of actuated positions while the other control element is held in a predetermined position.

It will be appreciated that while a specific embodiment of the invention has been described and disclosed in detail, numerous modifications come to mind without departing from the spirit of the invention. Control element 40 could be moved between more than two positions illustrated in the drawings. For example, the control element could be moved to any number of positions provided these positions are clearly defined by the control element or the associated unit that is being controlled. In such an arrangement, it would be desirable to have an arcuate recess for each of the positions of control element 40.

Also, control lever 28 could be biased to either the position shown in FIG. 4 or in FIG. 5 and could be moved to the other position by manual force supplied to the control lever. Control member 40 could be biased to the position illustrated in FIG. 4 and the force on the control lever would then be utilized to move the control element from the position illustrated in FIG. 4 to that illustrated in FIG. 5.

While the shifting mechanism has been specifically described as being used to move two control elements associated with a transmission, the shifting mechanism can be used for any system where two control elements are to be moved by one lever and one control element needs to be moved while the other control element is in any given position.

What is claimed is:

1. A shifting mechanism including a control lever rotated on a fixed axis adjacent a control member having a recess receiving a portion of said lever so that movement of said control lever will move said control member to a plurality of distinct positions, said lever being pivoted between first and second positions about a second axis perpendicular to said fixed axis, a control element pivoted about a third axis spaced from said second axis, and cooperating means between said control lever and said control element for moving said control element between positions in response to pivotal movement of said control lever between said positions, said cooperating means accommodating rotational movement of said lever about said fixed axis in any position for said control element, said lever being pivotable about said second axis between said first and second positions at each of said distinct positions of said control member so that said control element can be moved between positions of any of said distinct positions of said control member.

2. A shifting mechanism as defined in claim 1, further including a quadrant spaced from said fixed axis and defining a plurality of elongated parallel recesses equal in number to said positions of said control lever with said control lever having a projection located in the respective recesses for the respective positions of said lever.

3. A shifting mechanism as defined in claim 2, in which said quadrant has a plurality of slots at spaced locations interconnecting said recesses so that said lever can be moved between said positions at a plurality of locations.

4. A shifting mechanism including a control lever for shifting first and second control elements that are pivoted about first and second fixed axes angularly related to each other, said lever being rotated about said first axis and engaging said first element for rotating said first element between a plurality of distinct positions, said lever being pivotable along said first axis, an elongated member pivoted about a third axis between first and second positions in response to pivotal movement of said control lever and having cooperating means for moving said second element, said elongated member accommodating rotational movement of said control lever in either of said first and second positions so that said first control element can be rotated to a plurality of locations while said second element is in any position.

5. A shifting mechanism as defined in claim 4, in which said elongated member is substantially U-shaped in cross section defining a pair of opposed legs with said second element having a recess receiving a portion of one of said legs and said lever has an arm received between said legs for movement along said member during rotational movement of said lever.

6. A shifting mechanism as defined in claim 5, further including guide means cooperating with said lever for guiding said lever along a path in either position during rotational movement.

7. A shifting mechanism as defined in claim 6, in which said lever is pivotable between first and second positions and said guide means includes a quadrant defining first and second axially spaced arcuate recesses around said first axis, said arcuate recesses being interconnected by a plurality of circumferentially spaced slots, said lever having a projection received into one of said recesses and being movable to the other recess through any of said slots.

8. A shifting mechanism including a control lever rotated on a fixed axis adjacent a control member having a recess receiving a portion of said lever so that movement of said control lever will move said control member between a plurality of locations, said lever being pivoted between a plurality of positions about a second axis perpendicular to said fixed axis, a control element pivoted about a third axis spaced from said second axis, cooperating means between said control lever and said control element for moving said control element between positions in response to pivotal movement of said control lever between said positions, said cooperating means accommodating rotational movement of said lever about said fixed axis in any position for said control element and a quadrant spaced from said fixed axis and defining a plurality of elongated parallel recesses equal in number to said positions of said control lever with said control lever having a projection located in the respective recesses for the respective positions of said lever, said cooperating means including a U-shaped member having opposed legs pivoted about an axis between said fixed axis and said quadrant, one of said legs cooperating with said control element, said lever having an arm secured thereto and extending between said legs so that pivotal movement of said lever between said positions will pivot said U-shaped member and said control element between positions.

9. A shifting mechanism as defined in claim 8, in which said lever is pivoted between first and second positions and said quadrant has a pair of parallel recesses.

* * * * *